United States Patent [19]

Hutchings et al.

[11] Patent Number: 4,513,102

[45] Date of Patent: Apr. 23, 1985

[54] CATALYST FOR COATING ANODES AND A PROCESS FOR ITS PREPARATION

[75] Inventors: Ron Hutchings, Rondebosch, South Africa; Ruzica Loitzl, Kirchdorf; Klaus Müller, Baden, both of Switzerland

[73] Assignee: BBC Brown, Boveri & Company, Limited, Baden, Switzerland

[21] Appl. No.: 581,991

[22] Filed: Feb. 21, 1984

[30] Foreign Application Priority Data

Mar. 11, 1983 [CH] Switzerland ..... 1344/83

[51] Int. Cl.[3] ..... C25B 11/00

[52] U.S. Cl. ..... 502/325; 502/101; 502/349; 204/290 F

[58] Field of Search ..... 204/290 F; 502/101, 502/325, 349

[56] References Cited

U.S. PATENT DOCUMENTS 3,793,164 2/1974 Kolb ..... 204/290 F 3,846,273 11/1974 Bianchi ..... 204/290 F

*Primary Examiner*—John F. Niebling

*Attorney, Agent, or Firm*—Oblon, Fisher, Spivak, McClelland & Maier

[57] ABSTRACT

A catalytic powder for coating an anode consisting essentially of 2–45 mol % of $RuO_2$, 2–45 mol % of $IrO_2$ and 10–96 mol % of $SnO_2$. The powder has a rutile crystal type, at least partially as a mixed oxide and has uniform lattice parameters which lie between the values of $RuO_2$ and $IrO_2$ and the value of $SnO_2$. This catalytic powder is prepared by treating $H_2IrCl_6.m\ H_2O$, $RuCl_3.n\ H_2O$ and $SnCl_2$, wherein m is between 4.1 and 5.5 and n is between 2.5 and 3.85, with an alcohol. The resulting solution is then evaporated. The powder obtained is dried and ignited for $\frac{1}{2}$ to 6 hours between 400°–500° C. and then cooled.

5 Claims, 1 Drawing Figure

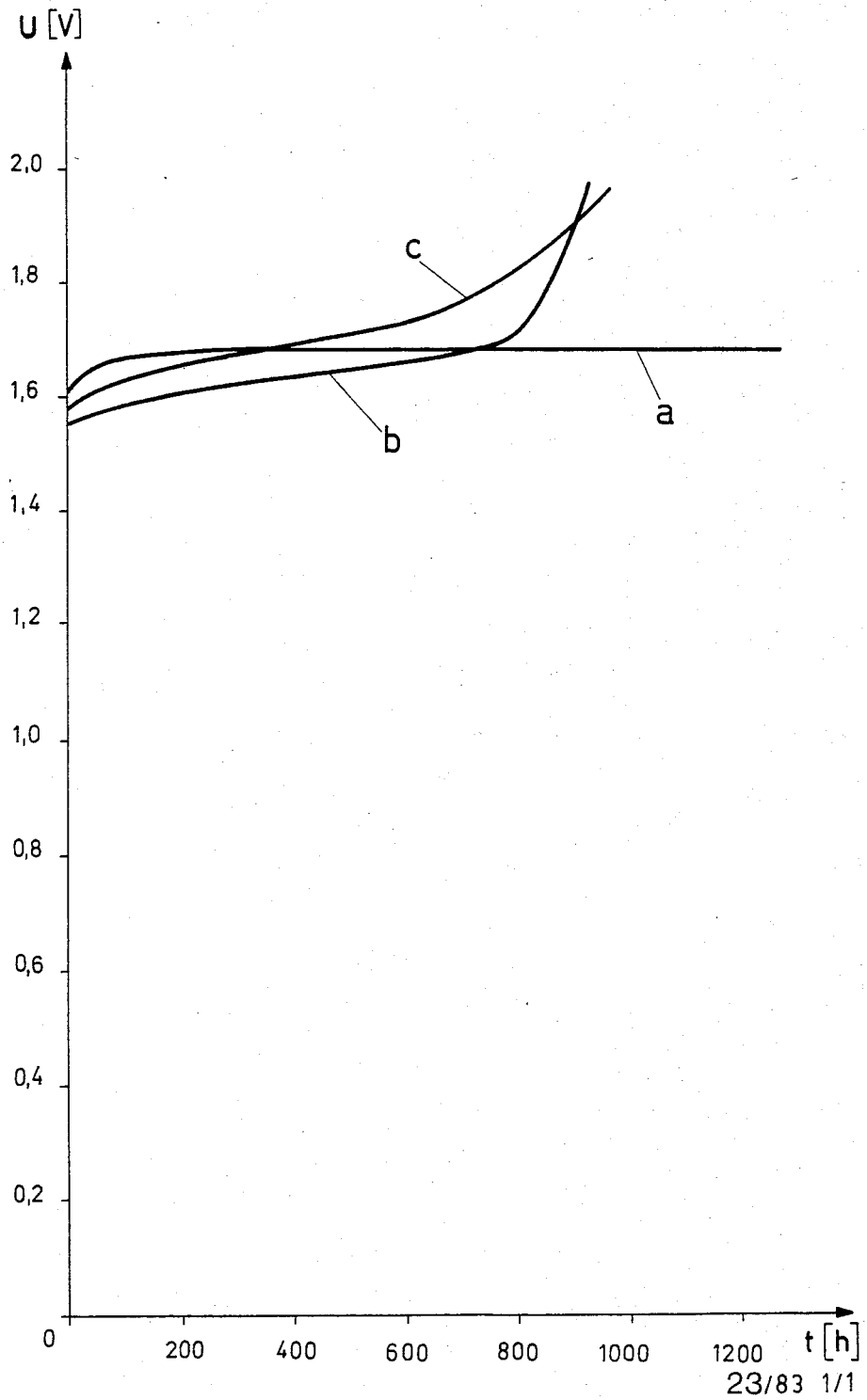
U [V]
2,0
1,8
1,6
1,4
1,2
1,0
0,8
0,6
0,4
0,2
0
200
400
600
800
1000
1200
t [h]
a
b
c
23/83 1/1

CATALYST FOR COATING ANODES AND A PROCESS FOR ITS PREPARATION

BACKGROUND OF THE INVENTION

The invention pertains to a catalyst for coating anodes, in electrochemical cells using a mixture of electronically conductive platinum metal oxides comprising $RuO_2$, $IrO_2$ and $SnO_2$, and a process for its preparation, comprising forming a solution of water containing $H_2IrCl_6.mH_2O$, $RuCl_3.nH_2O$ and $SnCl_2$, and evaporating the solution to obtain a powder, which is dried and ignited at high temperatures prior to cooling.

It is known to accelerate and to promote electrochemical processes by catalysts applied to the electrodes. For this purpose, platinum metals and platinum metal oxides as well as mixtures thereof are preferably used on the anode side (for example the oxygen side of water electrolysis). In electrochemical cells which use a plastic polymer in the form of a diaphragm as a solid electrolyte, mixtures of $RuO_2$ and $IrO_2$ have proved particularly suitable. These platinum metal oxides are applied, as a rule in the form of powder, to the current collectors of the anode side (depassivated, porous titanium) (U.S. Pat. No. 4,326,943); Bockris, Conway, Yeager, White, Comprehensive treatise of electrochemistry, Vol. 2: Electrochemical processing, pages 61–78, Plenum Press, New York and London 1981). When operating such an electrochemical cell in practice, it was then found that even the electro-catalyst mixtures closest to the optimum suffer a certain amount of corrosion. As a result, the operating period and hence the life of the cell are limited. In accordance with the conditions of the surroundings (active oxygen, strongly acidic medium), a higher stability must be demanded from such a catalyst.

It has also been proposed in the past to add further oxides, for example those of the elements Ti, Sn, Bi, Sb and Ge, to the noble metal oxides in order, allegedly, to increase the stability of catalysts, another aim also being the formation of films (German Specification No. B-2,213,084; PCT Application No. WO 79/00,842). Nevertheless, it was not possible substantially to increase the life as compared with pure noble metal oxides as the catalyst mixtures. Moreover, the electrode activity suffered considerably in the case of coherent films.

There is therefore a need to search for further catalyst mixtures, a substantial improvement in the stability and a reduction in the material costs without a deterioration of the electrode activity appearing to be desirable.

SUMMARY OF THE INVENTION

It is the object of the invention to indicate a catalyst for coating anodes in electrochemical cells, and a process for the preparation thereof, which catalyst has a higher stability and a higher corrosion resistance in a strongly acidic, oxygen-containing medium as compared with conventional platinum metal oxide mixtures and has a longer life. The catalyst should also have a high electronic conductivity.

This object is achieved by coating anodes in electrochemical cells with a catalytic mixture consisting essentially of 2–45 mol percent of $RuO_2$, 2–45 mol percent of $IrO_2$ and 10–96 mol percent of $SnO_2$. This mixture, at least partially as a mixed oxide, has a rutile crystal type having uniform lattice parameters which lie between the values of $RuO_2$ and $IrO_2$ on the one hand and those of $SnO_2$ on the other hand. This catalytic mixture is obtained by treating $H_2IrCl_6.m\ H_2O$, $RuCl_3.n\ H_2O$ and $SnCl_2$, wherein m is between 4.1 and 5.5 and n is between 2.5 and 3.85, with ethanol or propanol. This solution has a total salt content between 1 to 20% by weight. The solution is then evaporated in a rotary evaporator and the powder obtained is dried and ignited for one half to six hours at a temperature between 400° and 500° C. and cooled.

DETAILED DESCRIPTION OF THE INVENTION

The invention is explained by reference to an illustrative embodiment explained in more detail by a FIGURE.

The FIGURE shows the curve of the potential at the oxygen-evolving electrode as a function of time, as a result of an accelerated life test for various catalyst compositions. The electrode consisted of an inert, porous, conductive current collector of 1 $cm^2$ surface area, which was coated in each case with a quantity of 3 mg of catalyst per $cm^2$ of active surface area of the current collector. The open electrolyte used was 6-normal sulfuric acid. The electrode was loaded in successive periods with a current density of 1 $A/cm^2$. The reference electrode used was a reversible hydrogen electrode in the same electrolyte. In order to minimise the influence of the ohmic voltage drop, the potential measurements themselves were carried out at appropriate intervals with a reduced current density of 0.1 $A/cm^2$.

Curve "a" applies to a catalyst of the formula $$(Sn_{0.5}Ir_{0.25}Ru_{0.25})O_2$$

and a=curve of the potential at the oxygen-evolving electrode as a function of time according to an accelerated lift test of the catalyst.

After as short a time as 200 hours, the initial potential of about 1.61 V levels out at the unchanged value of about 1.68 V, which remained constant even in tests of more than 1200 hours duration. For comparison, two further measured results are also plotted. Curve "b" refers to a conventional catalyst of the composition $$(Ir_{0.5}Ru_{0.5})O_2$$

and b=curve of the potential as a function of time for the catalyst, whilst a curve "c" applies to pure ididium oxide $$IrO_2$$

and c=curve of the potential as a function of time for the catalyst.

The two latter curves show a marked steady rise of the potential from initial values lying at 1.55 V ("b") and at 1.58 V ("c"), and a drastic steep rise is to be observed after a period of about 800 hours.

ILLUSTRATIVE EXAMPLE

A catalyst mixture of the following formula was prepared in the corresponding empirical composition:

$$(Sn_{0.5}Ir_{0.25}Ru_{0.25})O_2.$$

The starting materials used were the following compounds:

| | | |
|---|---|---|
| $SnCl_2$ | (tin chloride from Fluka) | 2.15 g corresponding to 32.7% |
| $H_2IrCl_6.mH_2O$ | (chloroiridic acid from Degussa with 38.5% by weight relative of Ir) | 2.82 g corresponding to 43.4% |
| $RuCl_3.nH_2O$ | (ruthenium chloride from Degussa with 36.5% by weight relative of Ru) | 1.56 g corresponding to 23.9% |

The substances mentioned above were each individually dissolved in 15 to 25 times the quantity (preferably in 35 to 55 g) of 2-propanol. If necessary, ultrasonics can be applied for this purpose in an advantageous manner. The individual solutions were mixed with one another, and a colour change from red-brown to intensively green was to be observed. The combined solution was evaporated almost to dryness (black colouration) in a rotary evaporator at a waterbath temperature of 60° C. under a vacuum generated by a water pump. The residue was then fully dried for 3 hours in a vacuum drying cabinet at a temperature of 80° to 120° C. (preferably 100° C.) and was then heated for a further 3 hours in air at a temperature of 450° C. The black powder obtained in this way was then ground to fine particles in a mortar. The specific surface area of the powder was about 28 $m^2/g$. The yield, without taking account of losses, was about 70%. The powder showed a nonuniform particle size distribution, the $SnO_2$ content varying with the particle size. The finer fractions had particle sizes of about 5 to 10 nm, whilst the coarser fractions had particle sizes of up to more than 100 nm. The lattice parameters of the material in the important fine fraction were determined to be $a=4.60$ Å and $c=3.18$ Å.

For carrying out the accelerated life test, the catalyst powder was applied to a platinised titanium support of 1 $cm^2$ surface area, used as current collector. The results can be seen from the FIGURE.

The invention is not restricted to the illustrative example described above. Instead of 25 mol % of $RuO_2$, 25 mol % of $IrO_2$ and 50 mol % of $SnO_2$, the catalyst mixture can in principle contain 2 to 45 mol % of $RuO_2$, 2 to 45 mol % of $IrO_2$ and 10 to 96 mol % of $SnO_2$, the material belonging, at least partially as a mixed oxide, to the rutile crystal type and having uniform lattice parameters, the values of which lie between those of $RuO_2$ and $IrO_2$ on the one hand and those of $SnO_2$ on the other hand. The particle size of the catalyst powder can here vary from 3 to 3000 nm and the specific surface area can be 10 to 100 $M^2/g$.

The coefficients of the noble metal salt hydrates can in practice vary within the following limits:

$4.1 \leqq m \leqq 5.6$ $2.5 \leqq n \leqq 3.85$

The dissolution of the starting materials can be effected by means of ethanol or propanol, and the solutions can have a total salt content of 1 to 20% by weight. Ignition of the dried powder can be carried out for ½ to 6 hours at a temperature from 400° to 500° C.

We claim:

1. A catalytic powder for coating anodes in electrochemical cells, consisting essentially of 2 to 45 mol % of $RuO_2$, 2 to 45 mol % of $IrO_2$ and 10 to 96 mol % of $SnO_2$; wherein said powder belongs, at least partially as a mixed oxide, to the rutile crystal type having uniform lattice parameters, the values of which lie between those of $RuO_2$ and $IrO_2$ on the one hand and those of $SnO_2$ on the other hand.

2. The catalytic powder of claim 1, consisting essentially of 25 mol % of $RuO_2$, 25 mol % of $IrO_2$ and 50 mol % of $SnO_2$, wherein the lattice parameters are $a=4.60$ Å and $c=3.18$ Å.

3. The catalytic powder of claim 1, wherein said powder has a particle size of 3 to 3000 nm and a specific surface area of 10 to 100 $m^2/g$.

4. A process for preparing a catalyst for coating anodes in electrochemical cells, comprising treating the water-containing starting materials $H_2IrCl_6.m\ H_2O$, $RuCl_3.n\ H_2O$ and $SnCl_2$, wherein $4.1 \leqq m \leqq 5.5$ and $2.5 \leqq n \leqq 3.85$ with ethanol or propanol to give a solution of 1 to 20% by weight total salt content in the solvent; evaporating said solution in a rotary evaporator; drying and igniting the resulting powder for ½ to 6 hours at a temperature from 400° to 500° C.; and then cooling the powder to yield the catalyst.

5. The process of claim 4, wherein the water-containing starting materials, 2.82 g of $H_2IrCl_6.m\ H_2O$ with 38.5% by weight relative of Ir, 1.56 g of $RuCl_3.n\ H_2O$ with 36.5% by weight relative of Ru and 2.15 g of $SnCl_2$, are each dissolved in 15 to 25 times the quantity of 2-propanol; the resulting solutions are then mixed and evaporated, and the mass obtained is then dried at 100° C. in a vacuum drying cabinet and ignited at 450° C. for 3 hours.

* * * * *